United States Patent [19]

Van Manen

[11] 4,326,650

[45] Apr. 27, 1982

[54] DISPENSING SYSTEM USING CARTRIDGE WITH INTERLOCKING PLUNGER

[75] Inventor: Dick T. Van Manen, Canandaigua, N.Y.

[73] Assignee: Voplex Corporation, Pittsford, N.Y.

[21] Appl. No.: 132,800

[22] Filed: Mar. 24, 1980

Related U.S. Application Data

[63] Continuation-in-part of Ser. No. 92,440, Nov. 7, 1979.

[51] Int. Cl.[3] ..... B67D 5/42

[52] U.S. Cl. ..... 222/386

[58] Field of Search ..... 222/327, 386, 387, 388, 222/389, 390, 391, 326; 220/355

[56] References Cited

U.S. PATENT DOCUMENTS

| | | | |
|---|---|---|---|
| 2,855,130 | 10/1958 | Hosler | 222/327 X |
| 2,887,253 | 5/1959 | Biedenstein | 222/327 |
| 2,941,699 | 6/1960 | Schmidt et al. | 222/327 |
| 3,193,146 | 7/1965 | Isgriggs et al. | 222/391 |
| 3,942,679 | 3/1976 | Starr | 220/355 |
| 4,209,107 | 6/1980 | Crisci | 220/355 |

OTHER PUBLICATIONS

Nielson, D.; WD 79/OD 758, PCT., 10/4/79.

*Primary Examiner*—Allen N. Knowles

*Attorney, Agent, or Firm*—Stonebraker, Shepard & Stephens

[57] ABSTRACT

A dispensing system uses a molded resin cartridge 10 and a plunger 11 arranged with an interlock that prevents the plunger from backing out of the rear end of the cartridge. The cartridge wall 12 has an interlock surface 20 just forward of its open rear end 13, and a locking ring 40 has a sleeve 25 extending around the outside of the cartridge wall with a hook 27 that engages interlock surface 20. A radial wall 41 of the locking ring holds the plunger 11 against moving out of the rear end of the cartridge and improves the seal between the plunger and cartridge. The radial wall 41 can be joined to the plunger skirt 15 along a line of weakness 31 that allows sleeve 25 to tear away as the plunger advances to dispense the cartridge contents.

8 Claims, 8 Drawing Figures

DISPENSING SYSTEM USING CARTRIDGE WITH INTERLOCKING PLUNGER

RELATED APPLICATIONS

This application is a continuation-in-part of my parent application Ser. No. 092,440, filed Nov. 7, 1979, entitled CARTRIDGE WITH INTERLOCKING PLUNGER, and abandoned upon the filing of this CIP application.

BACKGROUND OF THE INVENTION

My invention involves a better dispensing system using a cartridge and plunger formed so that the plunger is locked onto and sealed to the rear end of the cartridge. It was developed especially for a large cartridge having a diameter of about five inches and a dispensing gun having a powered pusher to drive the plunger forward during dispensing. There is no reason why my invention could not also apply to smaller cartridges and plungers that are not necessarily advanced by power driven pushers.

My invention aims at simplicity, economy, and effectiveness in a cartridge and plunger interrelationship that both locks and seals. A locking arrangement connects the plunger securely to the rear end of the cartridge so that it will not come loose or be backed out by contents expansion, and the plunger also serves as a secure seal closing the rear end of the cartridge tightly enough to protect the contents. The plunger keeps the dispensing gun pusher clean during operation and allows dispensing simply by driving the plunger forward.

SUMMARY OF THE INVENTION

My inventive dispensing system uses a molded resin cartridge with a cylindrical wall having an open rear end and a molded resin plunger with a skirt that fits inside the cylindrical wall so the plunger can be seated in the rear end of the cartridge after the cartridge is filled. A pusher received by the plunger engages and advances the plunger into the cartridge, and the cartridge is held during the plunger advance to dispense the cartridge contents. The cartridge has an interlock surface spaced a short distance forward from the open rear end, and the interlock surface extends outward from the outer surface of the cylindrical wall. The interlocking surface also faces forward away from the open rear end and extends around the cartridge wall along the intersection of the wall and a plane perpendicular to the axis of the cartridge forward from the open rear end. A molded resin locking ring formed as a generally cylindrical outer sleeve extends forward around the outside of the cartridge wall. The inner surface of the sleeve extends rearward of the interlock surface, and the sleeve has a hook surface extending inward from the inner surface of the sleeve. The hook surface faces rearward toward the open rear end of the cartridge. The hook surface also extends around the sleeve along the intersection to hook over the interlock surface and hold the sleeve from moving toward the rear end of the cartridge. A radial wall of the locking ring extends inward from the sleeve and over the rear end of the cartridge wall. The radial wall prevents the plunger from moving rearwardly out the rear end of the cartridge allowing the locking ring to improve the seal and security of the plunger as it seats in the cartridge.

DRAWINGS

DETAILED DESCRIPTION

Figure 1:
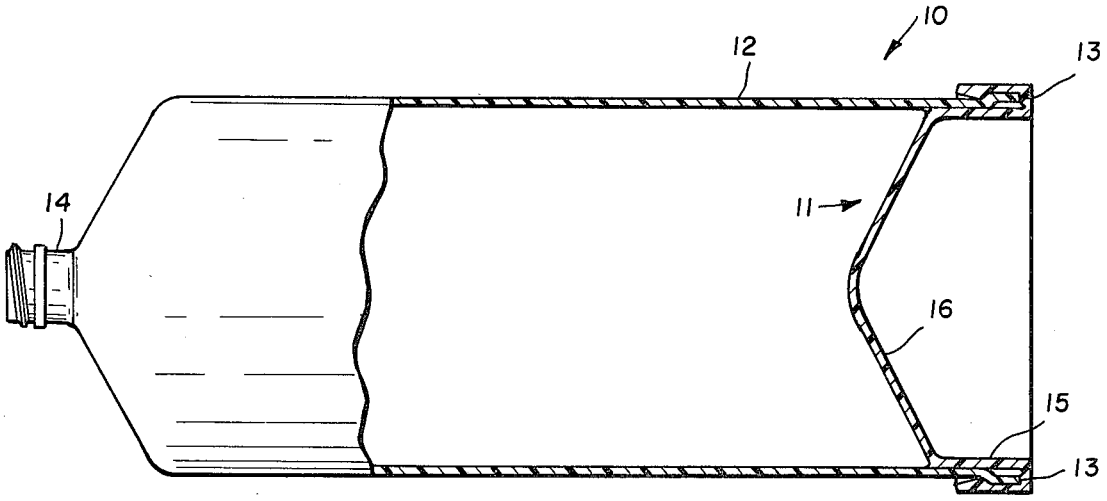
FIG. 1 is a partially cut-away, side elevational view of a preferred embodiment of my inventive cartridge and plunger.

Using generally known technology and resin materials, I prefer blow molding cartridge 10 and injection molding plunger 11 in the illustrated shapes. Cartridge 10 is similar to a blow molded bottle with a generally cylindrical wall 12 with an open rear end 13 and a neck 14 at its forward end for holding a dispensing nozzle (not shown). A nozzle can also be molded directly on the forward end of cartridge 10, and other molding methods and shapes and sizes other than the ones illustrated can be used.

Plunger 11 has a cylindrical skirt 15 that fits the inside of cartridge wall 12, and a central region 16 of plunger 11 inside cylindrical skirt 15 closes off the rear end of the cartridge and can have many shapes besides the generally conical shape illustrated.

Figure 2:
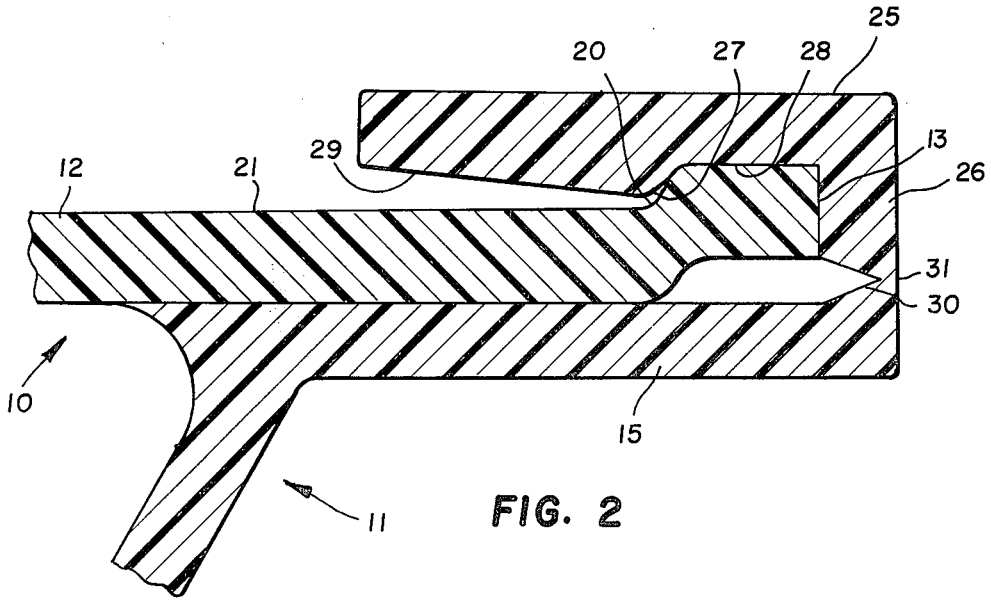
FIG. 2 is an enlarged fragmentary cross-sectional view showing the seated interrelationship of the plunger and cartridge of FIG. 1.

The differences between my cartride and plunger and previous ones involve an interlock and seal that occurs when plunger 11 is in a seated relationship with the rear end of cartridge 10 as illustrated. The seal and interlock hold plunger 11 securely on cartridge 12, close and seal the rear end of cartridge 12 to protect the contents, and maintain a sealed interlock until the plunger advances in the cartridge to dispense the contents. FIG. 2 best shows how one preferred embodiment of this works.

A short distance forward of rear end 13 of cartridge wall 12 is an interlock surface 20 having several characteristics. Surface 20 extends generally radially outward from the outer surface 21 of cartridge wall 12 extending cylindrically forward of interlock surface 20. It also extends all the way around cartridge wall 12 along the intersection of wall 12 with a plane perpendicular to the axis of cartridge 12 and a little forward of rear end 13. Surface 20 also faces forward away from rear end 13 to provide a ridge or ledge; and as illustrated, it can slope from a radial plane. Interlock surface 20 is formed by an outward offset in cartridge wall 12 in the illustrated embodiment but can also be formed by an outwardly extending rib or by thickening wall 12 in the region just forward of rear end 13. Blow molding cartridge 10 allows these possibilities, but interlock surface 20 can also be formed by other resin-forming techniques.

Plunger skirt 15 has a generally cylindrical outer sleeve 25 joined to plunger skirt 15 by a radial web 26 extending around rear end 13. Sleeve 25 has a hook surface 27 that extends radially inward from the inner surface 28 of sleeve 25 that is rearward of hook surface 27. Hook surface 27 faces rearward toward open rear end 13 so that it confronts latch surface 20 when plunger 11 is seated on cartridge 10 as illustrated, and hook surface 27 also extends around the inside of sleeve 25 and follows along the line of interlock surface 20.

This allows hook surface 27 to snap over and interlock with surface 20 so that sleeve 25 firmly engages and hooks onto cartridge wall 12 near rear end 13. Sleeve 25 also has a taper 29 forward of hook surface 27 to facilitate sliding plunger 11 onto cartridge wall 12 until hook 27 snaps over interlock surface 20. This occurs only when plunger 11 is fully seated on the rear end of cartridge wall 12 with radial web 26 abutting against open rear end 13 of cartridge 10. The illustrated slopes of hook surface 27 and interlock surface 20 inclining from a plane perpendicular to the cartridge axis along the line of the hooked interlock provide a dimensional tolerance insuring that plunger 11 when hooked in place is drawn fully into seated engagement with the rear end 13 of cartridge 10.

Web 26 joining plunger skirt 15 and sleeve 25 is formed with a circular notch or groove 30 leaving a thin circular line of weakness 31 around the trailing edge of plunger skirt 15. This allows sleeve 25 and connecting web 26 to tear away as plunger 11 advances in cartridge 10 to dispense the contents. Groove 30 also allows plunger sleeve 25 to be cut away from plunger 11 by running a knife around line of weakness 31. Sufficient resin material extends across line of weakness 31 to maintain a secure seal and to join sleeve 25 securely to skirt 15, and yet the resin material around line 31 is thin enough to allow sleeve 25 to be torn or cut away easily when dispensing begins.

Hook 27 and interlock surface 20 provide a secure interlock mechanically holding plunger 11 on cartridge 10 and preventing plunger backout from contents expansion. Also, the surface-to-surface contact between plunger 11 and cartridge wall 12 extending from plunger skirt 15 around rear end 13 and up to the hooked interlock increases the effectiveness of the seal protecting the contents from exposure to air and moisture. Moreover, the interlock and seal involve a simple and economical structure using a tear-away part that does not impede dispensing.

Figure 3:
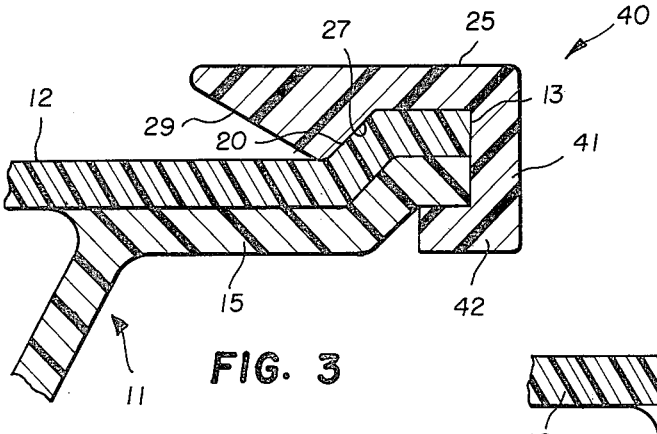
FIGS. 3–8 are enlarged, fragmentary cross-sectional views showing preferred alternatives for plunger locking devices according to my invention.
Figure 4:
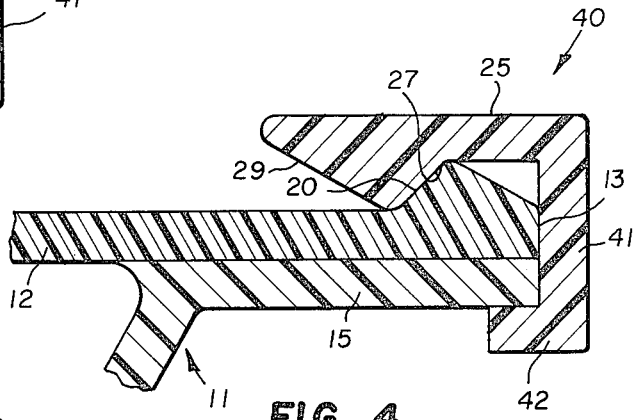
Figure 5:
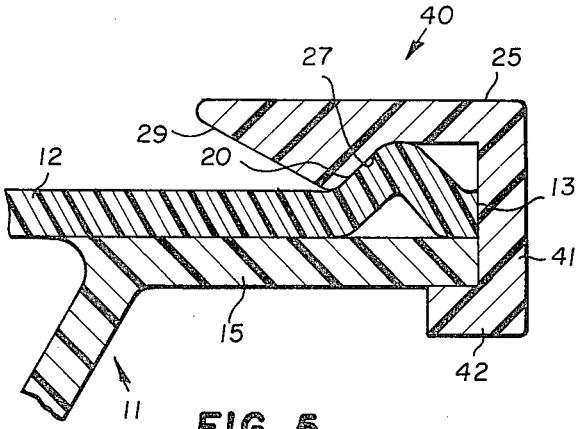

FIGS. 3–5 show preferred alternatives using a separate locking ring 40 not integrally joined to plunger skirt 15. Their differences involve ways of forming locking surface 20 at the rear end of the cartridge wall 12.

Locking ring 40 has an outer sleeve 25, hook surface 27, and taper 29 as previously described for hooking over and locking to interlock surface 20. Locking ring 40 also has a wall 41 extending radially inward across the rear end 13 of cartridge wall 12 to overlap the rear end of plunger 11 and prevent the plunger from backing out of the cartridge. Locking ring 40 also preferably has a retainer ring 42 that extends inward to engage the inner surface of plunger skirt 15 for securely engaging and holding plunger 11 and improving the seal between the plunger and cartridge. Plunger 11 moves freely clear of locking ring 40 as it advances into cartridge 12. The different ways of forming the interlock surface 20 at the rear end of cartridge wall 12 as shown in FIGS. 3–5 can be accomplished by blow molding, injection molding, or injection blow molding.

Figure 6:
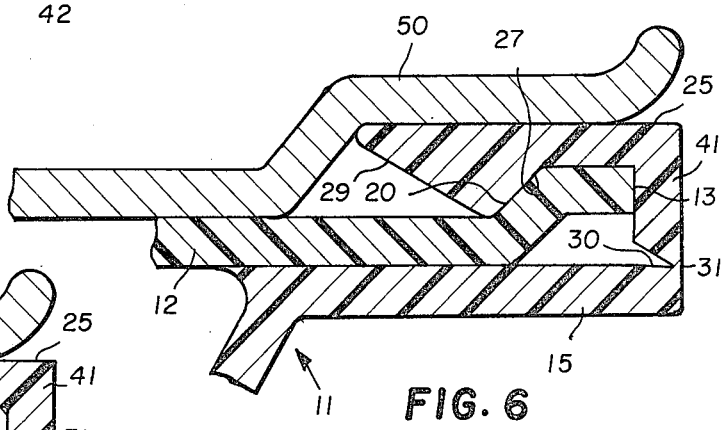

The embodiment of FIG. 6 is similar to the embodiment of FIGS. 1 and 2 except that a preferably metallic holder 50 formed as part of the dispensing equipment to hold the cartridge 12 during the advance of plunger 11 closely encircles outer sleeve 25 to retain it in locked position. Holder 50 then prevents loosening or unlocking of outer sleeve 25 as force is applied to advance plunger 11 and tear sleeve 25 from plunger skirt 15 along line of weakness 31.

Figure 7:
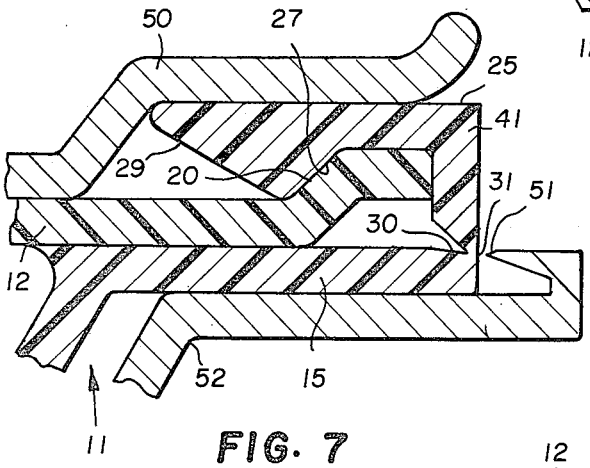

The embodiment of FIG. 7 is similar to the embodiment of FIG. 6 but adds a cutter 51 at the trailing end of a pusher 52 that forms part of the dispensing equipment and engages and advances plunger 11. Cutter 51 is positioned to sever sleeve 25 from plunger skirt 11 at line of weakness 31 just before pusher 52 fully seats in plunger 11 to advance plunger 11 into cartridge 12. At the same time, holder 50 closely encircling outer sleeve 25 helps retain sleeve 25 in place as it is cut away from plunger skirt 15.

Figure 8:
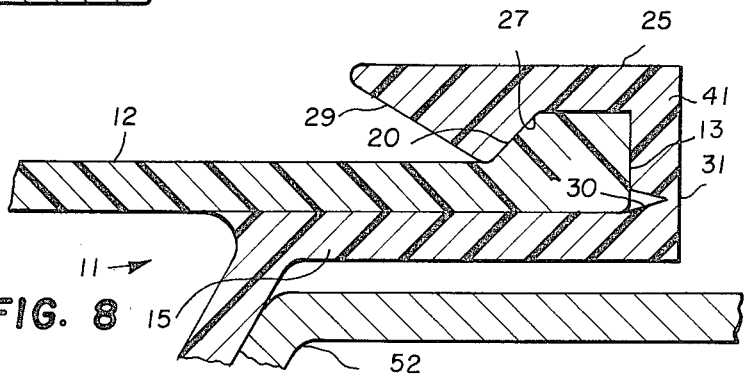

In the embodiment of FIG. 8, a pusher 52 has a diameter that is smaller than plunger skirt 15 so that outer sleeve 25 can unlock and evert around the rear end 13 of cartridge wall 12 and can trail plunger 11 as it advances into cartridge 12 by moving along in the clearance provided between pusher 52 and the inside of cartridge wall 12. Line of weakness 31 facilitates the eversion of outer sleeve 25 without requiring that sleeve 25 be torn or cut away from plunger skirt 15.

All the preferred variations of the invention as illustrated accomplish a secure interlock that keeps the plunger from backing out of the rear end of the cartridge and improves the seal between the plunger and cartridge. They also allow for plunger advance from the original seated position without requiring any special cutting, unlocking, or other operations so that the cartridge and plunger are ready for use in the dispensing equipment that merely advances pusher 52 against the plunger to begin dispensing the cartridge contents.

I claim:

1. A dispensing system using a molded resin cartridge with a generally cylindrical wall having an open rear end and a molded resin plunger with a skirt that fits the inside of said cylindrical wall so said plunger can be seated in a rear region of said cartridge to seal said open rear end after said cartridge is filled, said plunger being shaped to receive a pusher that engages and advances said plunger into said cartridge while a holder holds said cartridge during said plunger advance to dispense the contents of said cartridge, said dispensing system comprising:

a. said cartridge having an interlock surface spaced a short distance forward from said open rear end;

b. said interlock surface extending outward from the outer surface of said cylindrical wall;

c. said interlock surface extending around said cartridge wall along the intersection of said wall and a plane perpendicular to the axis of said cartridge forward from said open rear end;

d. said interlock surface facing forward away from said open rear end;

e. a cylindrical region of said plunger skirt supportively fitting against the inside of said cylindrical wall substantially forward of said interlock surface when said plunger is seated in said cartridge so said plane perpendicular to said cartridge axis intersects a rear region of said plunger;

f. a central region of said plunger extending across said cartridge when said plunger is seated in said cartridge being joined to a forward region of said skirt fitting against said cylindrical wall and located substantially forward of said plane perpendicular to said cartridge axis;

g. a molded resin locking ring formed as a generally cylindrical sleeve extending around said cartridge wall;

h. said sleeve having an inner surface extending rearward of said interlock surface;

i. said sleeve having a hook surface extending inward from said inner surface of said sleeve;

j. said hook surface facing rearward toward said open rear end of said cartridge;

k. said hook surface extending around said sleeve and along said intersection to hook over said interlock surface and hold said sleeve against movement toward said rear end of said cartridge;

l. said locking ring having a radial wall extending inward from said sleeve over said rear end of said cartridge wall; and m. said radial wall being arranged to prevent rearward movement of said plunger out of said rear end of said cartridge so said plunger and said locking ring cooperate to improve the seal and security of said cartridge.

2. The dispensing system of claim 1 wherein said interlock surface is formed as an outwardly offset step in said cartridge wall.

3. The dispensing system of claim 1 wherein said interlock surface is formed as a molded ridge around said cartridge wall.

4. The dispensing system of claim 1 wherein said sleeve is tapered forward of said hook surface to facilitate sliding said locking ring onto said cartridge wall and snapping said hook surface over said interlock surface.

5. The dispensing system of claim 1 wherein a retainer ring is formed around a radially inner edge of said radial wall of said locking ring to engage an inner surface of said plunger skirt in said rear region of said plunger.

6. The dispensing system of claim 1 wherein said radial wall of said locking ring is integrally joined to said plunger skirt along a tear-away line of weakness allowing said sleeve to tear away from said plunger skirt as said plunger advances in said cartridge.

7. The dispensing system of claim 6 wherein said holder closely encircles said sleeve of said locking ring to hold said sleeve in position around said cylindrical wall of said cartridge and facilitate tearing said plunger skirt away from said sleeve along said line of weakness.

8. The dispensing system of claim 1 wherein said radial wall of said locking ring is integrally joined to said plunger skirt, and said pusher has a diameter less than the inside diameter of said plunger so that said sleeve of said locking ring can evert around said rear end of said cartridge wall and follow said plunger as said plunger advances into said cartridge.

* * * * *